US010056177B2

(12) United States Patent
Sakuma et al.

(10) Patent No.: US 10,056,177 B2
(45) Date of Patent: Aug. 21, 2018

(54) METHOD FOR PRODUCING RARE-EARTH MAGNET

(71) Applicant: TOYOTA JIDOSHA KABUSHIKI KAISHA, Toyota-shi, Aichi (JP)

(72) Inventors: Noritsugu Sakuma, Toyota (JP); Tetsuya Shoji, Toyota (JP); Kazuaki Haga, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 11 days.

(21) Appl. No.: 14/610,229

(22) Filed: Jan. 30, 2015

(65) Prior Publication Data

US 2015/0228386 A1 Aug. 13, 2015

(30) Foreign Application Priority Data

Feb. 12, 2014 (JP) ..... 2014-024260

(51) Int. Cl.
*B22F 3/26* (2006.01)
*B22F 3/10* (2006.01)
(Continued)

(52) U.S. Cl.
CPC ..... *H01F 1/0577* (2013.01); *B22F 3/10* (2013.01); *B22F 3/24* (2013.01); *B22F 3/26* (2013.01);
(Continued)

(58) Field of Classification Search
None
See application file for complete search history.

(56) References Cited

U.S. PATENT DOCUMENTS 4,792,367 A 12/1988 Lee
5,641,363 A 6/1997 Fukuno et al.
(Continued)

FOREIGN PATENT DOCUMENTS

CN 1234589 A 11/1999
CN 1358595 A 7/2002
(Continued)

OTHER PUBLICATIONS

Machine translation of JP06-231926A, Aug. 1994.*
(Continued)

*Primary Examiner* — Xiaowei Su
(74) *Attorney, Agent, or Firm* — Sughrue Mion, PLLC

(57) ABSTRACT

The present invention is a method capable of producing a rare-earth magnet with excellent magnetization and coercivity. The method includes producing a sintered body including a main phase and grain boundary phase and represented by $(R1_{1-x}R2_x)_aTM_bB_cM_d$ (where R1 represents one or more rare-earth elements including Y, R2 represents a rare-earth element different than R1, TM represents transition metal including at least one of Fe, Ni, or Co, B represents boron, M represents at least one of Ti, Ga, Zn, Si, Al, etc., $0.01 \leq x \leq 1$, $12 \leq a \leq 20$, $b=100-a-c-d$, $5 \leq c \leq 20$, and $0 \leq d \leq 3$ (all at %)); applying hot deformation processing to the sintered body to produce a precursor of the magnet; and diffusing/infiltrating melt of a R3-M modifying alloy (rare-earth element where R3 includes R1 and R2) into the grain boundary phase of the precursor.

1 Claim, 9 Drawing Sheets

(51) Int. Cl.

| | |
|---|---|
| ***B22F 3/24*** | (2006.01) |
| ***H01F 1/057*** | (2006.01) |
| ***H01F 41/02*** | (2006.01) |
| ***H01F 1/055*** | (2006.01) |
| ***C22C 38/00*** | (2006.01) |
| ***C22C 38/10*** | (2006.01) |

(52) U.S. Cl.

CPC ..... *C22C 38/002* (2013.01); *C22C 38/005* (2013.01); *C22C 38/10* (2013.01); *H01F 1/0557* (2013.01); *H01F 41/0266* (2013.01); *H01F 41/0293* (2013.01)

(56) References Cited

U.S. PATENT DOCUMENTS

| | | | | |
|---|---|---|---|---|
| 6,319,335 | B1 | 11/2001 | Hirota et al. | |
| 8,846,136 | B2 * | 9/2014 | Shoji | C22C 38/005 427/127 |
| 9,257,227 | B2 * | 2/2016 | Haga | H01F 41/005 |
| 2003/0136469 | A1 | 7/2003 | Makita et al. | |
| 2005/0268989 | A1 | 12/2005 | Tomizawa et al. | |
| 2005/0284545 | A1 | 12/2005 | Komuro et al. | |
| 2006/0022175 | A1 | 2/2006 | Komuro et al. | |
| 2006/0278517 | A1 | 12/2006 | Machida et al. | |
| 2007/0240789 | A1 | 10/2007 | Nakamura et al. | |
| 2008/0223489 | A1 | 9/2008 | Nagata et al. | |
| 2009/0020193 | A1 | 1/2009 | Ohta et al. | |
| 2010/0003156 | A1 | 1/2010 | Suzuki et al. | |
| 2011/0000586 | A1 | 1/2011 | Nomura et al. | |
| 2011/0036460 | A1 | 2/2011 | Nagata et al. | |
| 2011/0090032 | A1 | 4/2011 | Nagata et al. | |
| 2012/0114515 | A1 | 5/2012 | Kaneko et al. | |
| 2012/0299675 | A1 | 11/2012 | Honkura | |
| 2012/0312422 | A1 | 12/2012 | Yano et al. | |
| 2013/0009736 | A1 | 1/2013 | Honkura et al. | |
| 2013/0078369 | A1 | 3/2013 | Shoji et al. | |
| 2013/0195710 | A1 | 8/2013 | Haga et al. | |
| 2014/0242267 | A1 * | 8/2014 | Shoji | C22C 28/00 427/127 |
| 2014/0283649 | A1 | 9/2014 | Kunieda et al. | |
| 2014/0308441 | A1 | 10/2014 | Shoji et al. | |
| 2015/0235747 | A1 | 8/2015 | Miyamoto et al. | |
| 2015/0279529 | A1 | 10/2015 | Ichigozaki et al. | |
| 2015/0287528 | A1 * | 10/2015 | Haga | C22C 38/00 264/611 |
| 2016/0141083 | A1 * | 5/2016 | Ito | C22C 33/02 252/62.55 |

FOREIGN PATENT DOCUMENTS

| | | | |
|---|---|---|---|
| CN | 100416719 | C | 9/2008 |
| CN | 101521068 | A | 9/2009 |
| CN | 101640087 | A | 2/2010 |
| CN | 102610347 | A | 7/2012 |
| CN | 102648502 | A | 8/2012 |
| CN | 103227019 | A | 7/2013 |
| EP | 1970924 | A1 | 9/2008 |
| JP | 2-47815 | A | 2/1990 |
| JP | 2-208902 | A | 8/1990 |
| JP | 06231926 | A * | 8/1994 |
| JP | 7-283016 | A | 10/1995 |
| JP | 8-250356 | A | 9/1996 |
| JP | 8-316014 | A | 11/1996 |
| JP | 9-275004 | A | 10/1997 |
| JP | 2693601 | B2 | 12/1997 |
| JP | 2002-144328 | A | 5/2002 |
| JP | 2007-524986 | A | 8/2004 |
| JP | 2005-209932 | | 8/2005 |
| JP | 2008-235343 | A | 10/2005 |
| JP | 2008-263179 | A | 10/2008 |
| JP | 4482769 | B2 | 10/2008 |
| JP | 2009-043813 | A | 2/2009 |
| JP | 2010-074084 | A | 4/2010 |
| JP | 2010-98115 | A | 4/2010 |
| JP | 2010-114200 | A | 5/2010 |
| JP | 2010-263172 | A | 11/2010 |
| JP | 2011-014668 | A | 1/2011 |
| JP | 2011-035001 | A | 2/2011 |
| JP | 2011-061038 | A | 3/2011 |
| JP | 4656323 | B2 | 3/2011 |
| JP | 2011-82467 | A | 4/2011 |
| JP | 2011-159733 | A | 8/2011 |
| JP | 4748163 | B2 | 8/2011 |
| JP | 2012-43968 | A | 3/2012 |
| JP | 2012-234985 | A | 11/2012 |
| JP | 2013-105903 | A | 5/2013 |
| JP | 5196080 | B2 | 5/2013 |
| JP | 2013-110387 | A | 6/2013 |
| JP | 2013-175705 | A | 9/2013 |
| KR | 10-2012-0135337 | A | 12/2012 |
| WO | 2004/072311 | A2 | 8/2004 |
| WO | 2004/081954 | A1 | 9/2004 |
| WO | 2005/066980 | A2 | 7/2005 |
| WO | 2011/043158 | A1 | 4/2011 |
| WO | 2011/070827 | A1 | 6/2011 |
| WO | 2011/070847 | A1 | 6/2011 |
| WO | 2012/008623 | A1 | 1/2012 |
| WO | 2012/036294 | A1 | 3/2012 |

OTHER PUBLICATIONS

C. Mishima, et al., "Development of a Dy-Free NdFeB Anisotropic Bonded Magnet with a High Thermal Stability", Proceedings of the 21st Workshop on Rare-Earth Permanent Magnets and their Applications, 2010, p. 253-256, REPM '10.

K. Makita, et al., "Boundary Structure and the Local Crystalline Electric Field of Nd—Fe—B Sintered Magnets", Journal of Magnetics Society of Japan, Oct. 1, 2002, pp. 1060-1067, vol. 26, No. 10.

S. Hirosawa, et al., "Recent Efforts Toward Rare-Metal-Free Permanent Magnets in Japan", Proceedings of the 21st Workshop on Rare-Earth Permanent Magnets and their Applications, 2010, pp. 187-191, REPM '10.

Tomoki Fukugawa, "Nd/NdFeB Artificial Interface Microstructure and the Intrinsic Coercivity of Surface $Nd_2Fe_{14}B$ Grains", NEOMAX Company, Hitachi Metals Ltd., Mar. 2008, pp. 40-45, vol. 24.

W.F. Li, et al., "The role of Cu addition in the coercivity enhancement of sintered Nd—Fe—B permanent magnets", J. Mater. Res., Feb. 2009, pp. 413-419, vol. 24, No. 2.

Wenjian Mo, et al., "Dependence of the crystal structure of the Nd-rich phase on oxygen content in an Nd—Fe—B sintered magnet", Scripta Materialia, pp. 179-182, vol. 59.

Matahiro Komuro et al., "Structure and magnetic properties of NdFeB powder surrounded with layer of rare-earth fluorides", Journal of Applied Physics, 2008, 4 pgs., vol. 103, 07E142.

Qiongzhen Liu et al., "Increased coercivity in sintered Nd—Fe—B magnets with $NdF_3$ additions and the related grain boundary phase", Scripta Materialia, 2009, pp. 1048-1051, vol. 61.

T. Fukugawa et al., "The effect of oxygen on the surface coercivity of Nd-coated Nd—Fe—B sintered magnets", Journal of Applied Physics, 2009, 4 pgs., vol. 105, 07A724.

S. Hirosawa et al., "Recent Efforts Toward Rare-Metal-Free Permanent Magnets in Japan", RERM' 10 Proceedings of the 21' Workshop on Rare-Earth Permanent Magnets and their Applications, pp. 187-192.

U.S. Non-Final Office Action issued in U.S. Appl. No. 14/441,695, dated Jul. 25, 2016.

U.S. Notice of Allowability issued in U.S. Appl. No. 13/750,576, dated Jan. 6, 2016.

U.S. Notice of Allowance issued in U.S. Appl. No. 13/750,576, dated Sep. 30, 2015.

U.S. Non-Final Office Action issued in U.S. Appl. No. 13/750,576, dated Jul. 16, 2015.

U.S. Non-Final Office Action issued in U.S. Appl. No. 14/237,702, dated Aug. 10, 2016.

U.S. Restriction Requirement issued in U.S. Appl. No. 14/237,702, dated Apr. 26, 2016.

(56) References Cited

OTHER PUBLICATIONS

U.S. Notice of Allowance issued in U.S. Appl. No. 13/700,601, dated Jun. 19, 2014.
U.S. Final Office Action issued in U.S. Appl. No. 13/700,601, dated Jan. 16, 2014.
U.S. Non-Final Office Action issued in U.S. Appl. No. 13/700,601, dated Jul. 16, 2013.
U.S. Non-Final Office Action dated Aug. 23, 2017, issued in U.S. Appl. No. 14/237,702.
Advisory Action dated Mar. 31, 2017, issued by USPTO in U.S. Appl. No. 14/237,702.
Final Office Action dated Apr. 3, 2018, which issued during the prosecution of U.S. Appl. No. 14/237,702.
U.S. Final Office Action issued in U.S. Appl. No. 14/441,695, dated Dec. 12, 2016.
U.S. Final Office Action issued in U.S. Appl. No. 14/237,702, dated Dec. 29, 2016.

* cited by examiner

METHOD FOR PRODUCING RARE-EARTH MAGNET

CLAIM OF PRIORITY

The present application claims priority from Japanese patent application JP2014-024260 filed on Feb. 12, 2014, the content of which is hereby incorporated by reference into this application.

BACKGROUND

Technical Field

The present invention relates to a method for producing a rare-earth magnet.

Background Art

Rare-earth magnets that use rare-earth elements are also called permanent magnets. Such magnets are used not only for hard disks or motors of MRI but also for driving motors of hybrid vehicles, electric vehicles, and the like.

As examples of magnetic performance indices of such rare-earth magnet, remanent magnetization (i.e., residual magnetic flux density) and coercivity can be given. However, with a reduction in the motor size and an increase in the amount of heat generation accompanied by an increase in the current density, there has been an increasing demand for higher heat resistance of the rare-earth magnet being used. Thus, how to retain the coercivity of a magnet under high-temperature use environments is an important research object to be achieved in the technical field.

For example, for a Nd—Fe—B-based magnet, which is one of the rare-earth magnets that are frequently used for vehicle driving motors, attempts have been made to increase the coercivity by, for example, reducing the crystal grain size, using an alloy with a high Nd content, or adding a heavy rare-earth element with high coercivity performance, such as Dy or Tb.

Examples of rare-earth magnets include typical sintered magnets whose crystal grains that form the structure have a scale of about 3 to 5 μm, and nanocrystalline magnets whose crystal grain size has been reduced down to a nano-scale of about 50 to 300 nm.

In order to increase the coercivity, which is one of the magnetic properties, of a rare-earth magnet, Patent Document 1 discloses a method of modifying a grain boundary phase by, for example, diffusing and infiltrating a Nd—Cu alloy or a Nd—Al alloy into the grain boundary phase, as a modifying alloy that contains a transition metal element and a light rare-earth element.

Such a modifying alloy that contains a transition metal element and a light rare-earth element has a low melting point as it does not contain a heavy rare-earth element, such as Dy. Thus, the modifying alloy melts at about 700° C. at the highest, and thus can be diffused and infiltrated into the grain boundary phase. Therefore, for a nanocrystalline magnet whose crystal grain size is less than or equal to about 300 nm, such a method is said to be a preferable processing method as it can improve the coercivity performance by modifying the grain boundary phase while at the same time suppressing coarsening of the nanocrystal grains.

By the way, in order to improve the magnetization of a rare-earth magnet, attempts have been made to increase the proportion of the main phase (e.g., to about 95% or greater). However, when the proportion of the main phase is increased, the proportion of the grain boundary phase will decrease correspondingly. Therefore, when a modifying alloy is diffused in the grain boundaries in such a case, a problem may occur such that the molten modifying alloy cannot sufficiently infiltrate the inside of the rare-earth magnet, resulting in decreased coercivity performance, though the magnetization improves.

For example, even Patent Document 1 does not deal with such a problem, and thus fails to disclose means for solving the problem.

RELATED ART DOCUMENTS

Patent Documents

Patent Document 1: International Publication No. WO2012/036294 A

SUMMARY

The present invention has been made in view of the foregoing problem, and it is an object of the present invention to provide a rare-earth magnet production method capable of producing a rare-earth magnet that is excellent not only in magnetization but also in coercivity performance even when the proportion of a main phase is high.

In order to achieve the above object, a method for producing a rare-earth magnet of the present invention includes a first step of producing a sintered body with a structure including a main phase and a grain boundary phase, the structure being represented by a compositional formula: $(R1_{1-x}R2_x)_aTM_bB_cM_d$ (where R1 represents one or more rare-earth elements including Y, R2 represents a rare-earth element different than R1, TM represents transition metal including at least one of Fe, Ni, or Co, B represents boron, M represents at least one of Ti, Ga, Zn, Si, Al, Nb, Zr, Ni, Co, Mn, V, W, Ta, Ge, Cu, Cr, Hf, Mo, P, C, Mg, Hg, Ag, or Au, $0.01 \le x \le 1$, $12 \le a \le 20$, $b=100-a-c-d$, $5 \le c \le 20$, and $0 \le d \le 3$ (all at %)); a second step of applying hot deformation processing to the sintered body to produce a precursor of a rare-earth magnet; and a third step of diffusing and infiltrating a melt of a R3-M modifying alloy (i.e., a rare-earth element where R3 includes R1 and R2) into the grain boundary phase of the precursor of the rare-earth magnet to produce a rare-earth magnet.

According to the method for producing the rare-earth magnet of the present invention, a melt of a R3-M modifying alloy (i.e., a rare-earth element where R3 includes R1 and R2) is diffused and infiltrated into a precursor of a rare-earth magnet, which has been obtained by applying hot deformation processing to a sintered body with a composition: $(R1_{1-x}R2_x)_aTM_bB_cM_d$ (where R1 represents one or more rare-earth elements including Y, and R2 represents a rare-earth element different than R1). Thus, it is possible to, even when the proportion of the main phase is high, sufficiently infiltrate the modifying alloy into the inside of the magnet while promoting the substitution phenomenon of the element with the modifying alloy at the interface of the main phase, and thus produce a rare-earth magnet with not only high magnetic performance, which is due to the high proportion of the main phase, but also high coercivity performance.

The phrase "high proportion of the main phase" in this specification means that the proportion of the main phase to the entire structure of the rare-earth magnet is about 95% or greater by volume percent.

Herein, examples of the rare-earth magnet produced with the production method of the present invention include not only a nanocrystalline magnet whose main phase (i.e., crystals) that forms the structure has a grain size of about less than or equal to 300 nm, but also a nanocrystalline magnet with a grain size of over 300 nm, a sintered magnet with a grain size of greater than or equal to 1 μm, and a bonded magnet whose crystal grains are bonded together with a resin binder.

In the first step, magnetic powder with a structure including a main phase and a grain boundary phase and represented by the aforementioned compositional formula is produced. For example, a quenched thin strip (i.e., a quenched ribbon) with fine crystal grains is produced through liquid quenching, and then, the quenched thin strip is coarsely ground, for example, to produce magnetic powder for a rare-earth magnet.

A die is filled with such magnetic powder, for example, and pressure is applied thereto with a punch to form a bulk, whereby an isotropic sintered body is obtained. Such a sintered body has a metal structure including a RE-Fe—B-based main phase with a nanocrystalline structure (where RE represents at least one of Nd or Pr; more specifically, one or more of Nd, Pr, or Nd—Pr), and a grain boundary phase of a RE-X alloy (where X represents a metal element) around the main phase. The grain boundary phase contains at least one of Ga, Al, or Cu in addition to Nd.

In the second step, hot deformation processing is applied to the isotropic sintered body to impart magnetic anisotropy thereto. Examples of the hot deformation processing include upset forging processing and extrusion processing (forward extrusion or backward extrusion). When processing strain is introduced into the inside of the sintered body using any of such methods either alone or in combination so as to perform high-strength processing with a degree of processing of about 60 to 80%, a rare-earth magnet is produced that has a high degree of orientation and excellent magnetization performance.

In the second step, the sintered body is subjected to hot deformation processing to produce a precursor of a rare-earth magnet that is an oriented magnet. In the third step, heat treatment is applied to a melt of a R3-M modifying alloy (i.e., a rare-earth element where R3 includes R1 and R2), for example, a modifying alloy containing a transition metal element and a light rare-earth element, under a relatively low temperature atmosphere (e.g., about 450 to 700° C.) for the precursor of the rare-earth magnet, so that the melt is diffused and infiltrated into the grain boundary phase of the precursor of the rare-earth magnet, and thus, a rare-earth magnet is produced.

As the main phase that forms the precursor of the rare-earth magnet contains not only Nd that is the R1 element but also Pr that is the R2 element, a substitution phenomenon occurs between the modifying alloy and the R2 element at the interface of the main phase, so that infiltration of the modifying alloy into the inside of the magnet is promoted.

For example, a case where a Nd—Cu alloy is used as the modifying alloy will be described in detail below. When the main phase contains Pr with a lower melting point than Nd, the outer side of the main phase (i.e., the interface region between the main phase and the grain boundary phase) dissolves due to heat that is generated while the Nd—Cu alloy is diffused in the grain boundaries, so that the dissolved region expands with the grain boundary phase in the molten state. Consequently, although the proportion of the grain boundary phase, which serves as the infiltration channel for the Nd—Cu alloy, has been low due to the high proportion of the main phase, and the infiltration rate of the Nd—Cu alloy has thus been low, it is possible to increase the efficiency of infiltration of the Nd—Cu alloy with the expanded infiltration channel. Consequently, the Nd—Cu alloy can sufficiently infiltrate the inside of the magnet.

Provided that Pr is not contained, both the main phase and the grain boundary phase are in a Nd-rich state, and thus, the outer side of the main phase does not dissolve due to heat that is generated while the Nd—Cu alloy is infiltrated. Thus, the infiltration channel for the Nd—Cu alloy, which is based on the low proportion of the grain boundary phase, remains narrow, and the efficiency of infiltration of the Nd—Cu alloy thus remains low. Consequently, the coercivity performance of the magnet cannot be increased.

After the Nd—Cu alloy is diffused in the grain boundaries by the heat treatment in the third step, the rare-earth magnet is returned to room temperature, so that the outer region of the main phase, which has dissolved so far, is recrystallized. Thus, a main phase with a core-shell structure is formed that includes a core in the center region of the main phase and a shell in the recrystallized outer region.

The thus formed main phase with the core-shell structure can maintain the initial high proportion of the main phase. Thus, it is possible to obtain a rare-earth magnet with excellent magnetization performance as well as excellent coercivity performance as the Nd—Cu alloy is sufficiently diffused in the grain boundaries of the grain boundary phase. Examples of such a core-shell structure includes a main phase with a core-shell structure that includes a (PrNd)FeB phase, which is a Pr-rich phase, as the composition of the core that forms the main phase, and a (NdPr)FeB phase, which is a relatively N-rich phase, as the composition of the shell around the main phase.

In the third step, a R3-M modifying alloy (i.e., a rare-earth element where R3 includes R1 and R2), for example, a modifying alloy that contains a transition metal and a light rare-earth element is diffused and infiltrated, whereby it becomes possible to perform modification at a lower temperature than when a modifying alloy containing a heavy rare-earth element, such as Dy, is used. In particular, in the case of a nanocrystalline magnet, a problem that crystal grains may become coarse can be solved.

Herein, a modifying alloy with a melting point or an eutectic point in the temperature range of 450 to 700° C. can be used as a modifying alloy that contains a transition metal element and a light rare-earth element. For example, an alloy that contains a light rare-earth element of one of Nd or Pr and a transition metal element, such as Cu, Mn, In, Zn, Al, Ag, Ga, or Fe, can be used. More specifically, a Nd—Cu alloy (eutectic point: 520° C.), Pr—Cu alloy (eutectic point: 480° C.), Nd—Pr—Cu alloy, Nd—Al alloy (eutectic point: 640° C.), Pr—Al alloy (650° C.), Nd—Pr—Al alloy, or the like can be used.

As can be understood from the foregoing descriptions, according to the method for producing the rare-earth magnet of the present invention, a melt of a R3-M modifying alloy (i.e., a rare-earth element where R3 includes R1 and R2) is diffused and infiltrated into a precursor of a rare-earth magnet, which has been obtained by applying hot deformation processing to a sintered body with a composition: $(R1_{1-x}R2_x)_aTM_bB_cM_d$ (where R1 represents one or more rare-earth elements including Y, and R2 represents a rare-earth element different than R1). Thus, it is possible to, even when the proportion of the main phase is high, sufficiently infiltrate the modifying alloy into the inside of the magnet while promoting the substitution phenomenon of the element with the modifying alloy at the interface of the main phase, and thus produce a rare-earth magnet with not only high magnetic performance, which is due to the high proportion of the main phase, but also high coercivity performance.

DETAILED DESCRIPTION OF THE EMBODIMENTS (Method for Producing Rare-Earth Magnet)

Figure 1A:
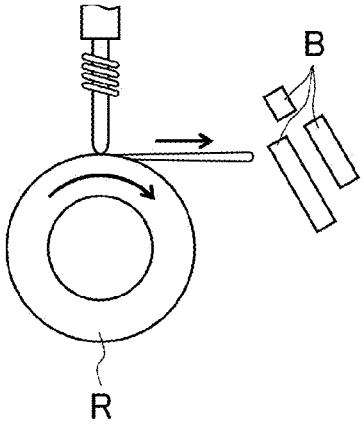
FIGS. 1A and B are schematic views sequentially illustrating a first step of a method for producing a rare-earth magnet of the present invention.
Figure 1B:
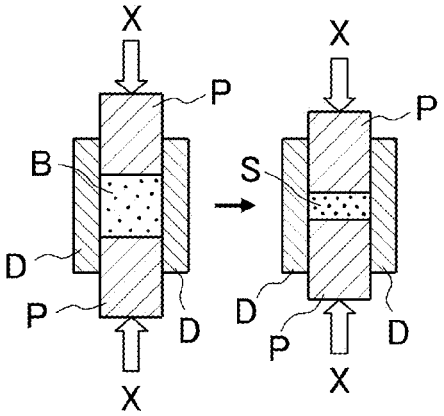
FIG. 1C is a schematic view illustrating a second step thereof.
Figure 1C:
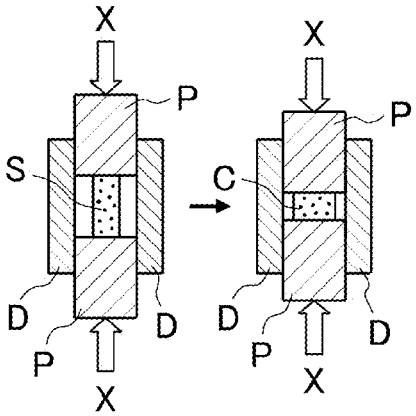
Figure 2A:
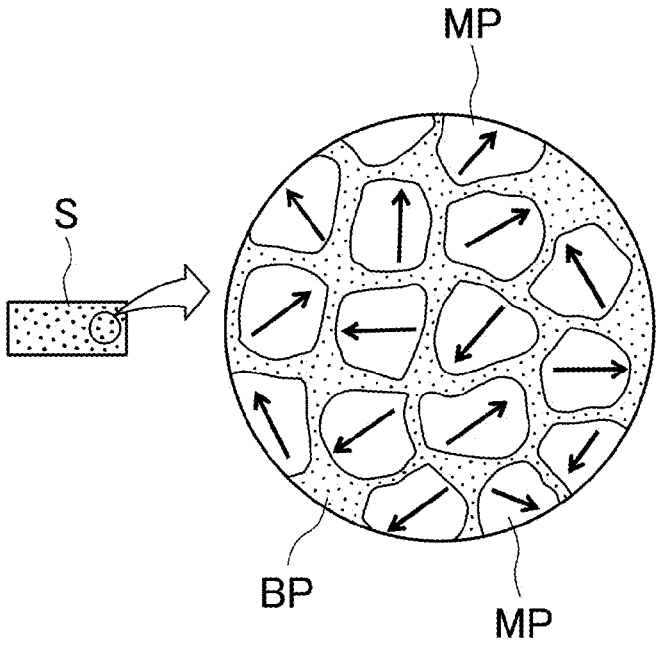
FIG. 2A is a view illustrating the micro-structure of a sintered body shown in FIG. 1B.
Figure 2B:
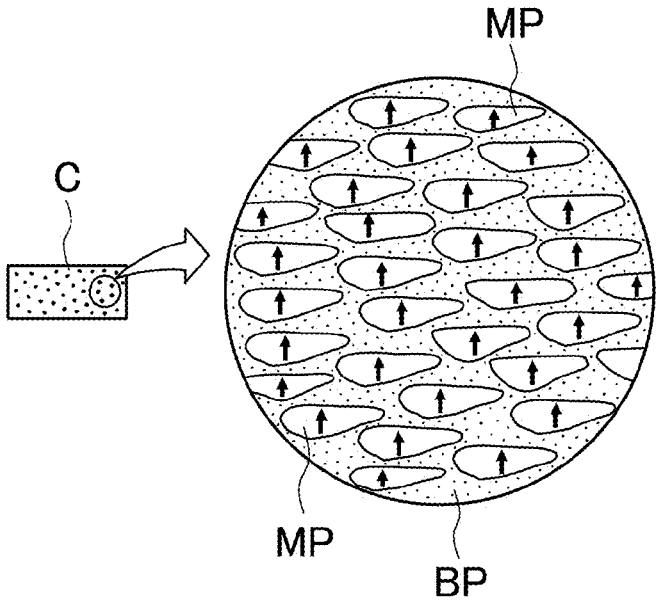
FIG. 2B is a view illustrating the micro-structure of a precursor of a rare-earth magnet shown in FIG. 1C.
Figure 3:
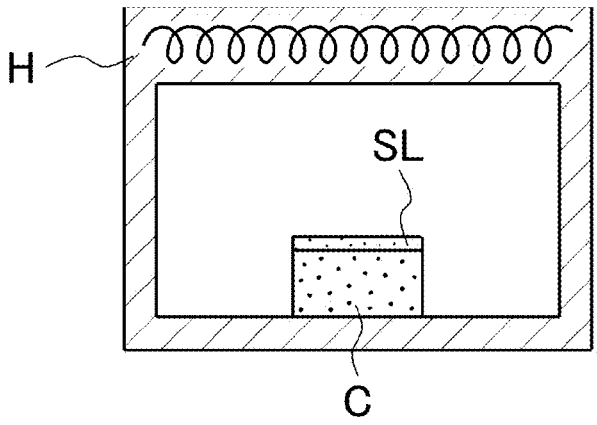
FIG. 3 is a schematic view illustrating a third step of the method for producing the rare-earth magnet of the present invention.
Figure 4:
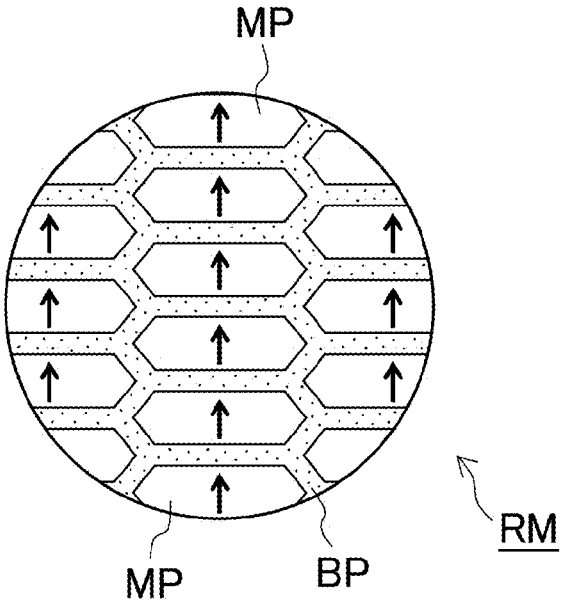
FIG. 4 is a view showing the micro-structure of the crystal structure of the produced rare-earth magnet.
Figure 5:
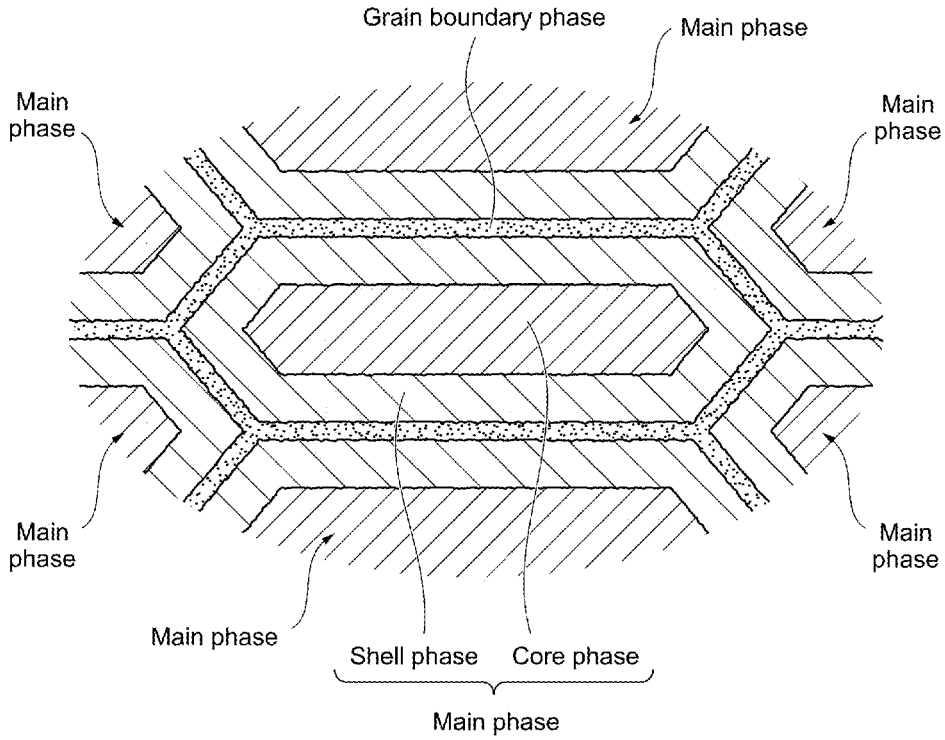
FIG. 5 is a further enlarged view of the main phase and the grain boundary phase in FIG. 4.

FIGS. 1A and 1B are schematic views sequentially illustrating a first step of a method for producing a rare-earth magnet of the present invention, and FIG. 1C is a schematic view illustrating a second step thereof. FIG. 3 is a schematic view illustrating a third step of the method for producing the rare-earth magnet of the present invention. In addition, FIG. 2A is a view illustrating the micro-structure of a sintered body shown in FIG. 1B, and FIG. 2B is a view illustrating the micro-structure of a precursor of a rare-earth magnet shown in FIG. 1C. Further, FIG. 4 is a view showing the micro-structure of the crystal structure of the produced rare-earth magnet. FIG. 5 is a further enlarged view of the main phase and the grain boundary phase in FIG. 4.

As shown in FIG. 1A, an alloy ingot is melted at high frequency through single-roller melt-spinning in a furnace (not shown) with an Ar gas atmosphere whose pressure has been reduced to 50 kPa or less, for example, and then the molten metal with a composition that will provide a rare-earth magnet is sprayed at a copper roll R to produce a quenched thin strip (i.e., a quenched ribbon) B. Then, the quenched thin strip B is coarsely ground.

A cavity, which is defined by a carbide die D and a carbide punch P that slides within a hollow space therein, is filled with coarse powder produced from the quenched thin strip B as shown in FIG. 1B, and then, pressure is applied thereto with the carbide punch P, and electrical heating is performed with current made to flow in the pressure application direction (i.e., the X-direction), whereby a sintered body S is produced that has a structure including a main phase and a grain boundary phase and represented by the compositional formula: $(R1_{1-x}R2_x)_aTM_bB_cM_d$ (where R1 represents one or more rare-earth elements including Y, R2 represents a rare-earth element different than R1, TM represents transition metal including at least one of Fe, Ni, or Co, B represents boron, M represents at least one of Ti, Ga, Zn, Si, Al, Nb, Zr, Ni, Co, Mn, V, W, Ta, Ge, Cu, Cr, Hf, Mo, P, C, Mg, Hg, Ag, or Au, $0.01 \le x \le 1$, $12 \le a \le 20$, $b=100-a-c-d$, $5 \le c \le 20$, and $0 \le d \le 3$ (all at %)). The main phase has a crystal grain size of about 50 to 300 nm (hereinabove, a first step).

As shown in FIG. 2A, the sintered body S has an isotropic crystal structure in which gaps between nanocrystal grains MP (i.e., main phase) are filled with a grain boundary phase BP. Herein, in order to impart magnetic anisotropy to the sintered body S, the carbide punch P is made to abut the end faces of the sintered body S in the longitudinal direction thereof (in FIG. 1B, the horizontal direction is the longitudinal direction) as shown in FIG. 1C, and hot deformation processing is applied thereto while pressure is applied with the carbide punch P (in the X-direction), whereby a precursor C of a rare-earth magnet with a crystal structure that contains anisotropic nanocrystal grains MP is produced as shown in FIG. 2B (hereinabove, a second step).

It should be noted that when the degree of processing (i.e., compressibility) of the hot deformation processing is high, for example, when the compressibility is greater than or equal to about 10%, the hot deformation processing can also be called hot high-strength processing or be simply called high-strength processing. However, processing is preferably performed at a degree of processing of about 60 to 80%.

In the crystal structure of the precursor C of the rare-earth magnet shown in FIG. 2B, the nanocrystal grains MP have flat shapes, and an interface that is substantially parallel with the anisotropy axis is curved or bent, and is not formed by a particular plane.

Next, as shown in FIG. 3, as a third step, modifying alloy powder SL is sprayed at the surface of the precursor C of the rare-earth magnet, and then, the precursor C is put in a high-temperature furnace H, and is kept therein under a high-temperature atmosphere for a predetermined retention time, whereby a melt of the modifying alloy SL is diffused and infiltrated into the grain boundary phase of the precursor C of the rare-earth magnet. It should be noted that the modifying alloy powder SL may be either processed into a plate shape so as to be placed on the surface of the precursor of the rare-earth magnet or be made into slurry so as to be applied to the surface of the precursor of the rare-earth magnet.

For the modifying alloy powder SL herein, a modifying alloy is used that contains a transition metal element and a light rare-earth element and has a eutectic point as low as 450 to 700° C. For example, it is preferable to use one of a Nd—Cu alloy (eutectic point: 520° C.), Pr—Cu alloy (eutectic point: 480° C.), Nd—Pr—Cu alloy, Nd—Al alloy (eutectic point: 640° C.), Pr—Al alloy (eutectic point: 650° C.), Nd—Pr—Al alloy, Nd—Co alloy (eutectic point: 566° C.), Pr—Co alloy (eutectic point: 540° C.), or Nd—Pr—Co alloy. Above all, it is more preferable to use an alloy with an eutectic point of less than or equal to 580° C., which is relatively low, such as a Nd—Cu alloy (eutectic point: 520° C.), Pr—Cu alloy (eutectic point: 480° C.), Nd—Co alloy (eutectic point: 566° C.), or Pr—Co alloy (eutectic point: 540° C.).

When the melt of the modifying alloy SL is diffused and infiltrated into the grain boundary phase BP of the precursor C of the rare-earth magnet, the crystal structure of the precursor C of the rare-earth magnet shown in FIG. 2B changes, and the interfaces of the crystal grains MP become clear as shown in FIG. 4. Thus, magnetic separation between crystal grains MP, MP progresses, and a rare-earth magnet RM with improved coercivity is produced (i.e., a third step). It should be noted that while the crystal structure is being modified by the modifying alloy shown in FIG. 4, an interface that is substantially parallel with the anisotropy axis is not formed yet (i.e., not formed by a particular plane), but in the stage where modification by the modifying alloy has sufficiently progressed, an interface that is substantially parallel with the anisotropy axis (i.e., a particular plane) is formed. Thus, a rare-earth magnet whose crystal grains MP exhibit rectangular shapes or shapes close to rectangular shapes, when seen from the direction orthogonal to the anisotropy axis, is formed.

As the main phase MP that partially constitutes the precursor C of the rare-earth magnet contains Pr that is the R2 element in addition to Nd that is the R1 element, for example, a substitution phenomenon occurs between the modifying alloy SL and the R2 element at the interface of the main phase, so that infiltration of the modifying alloy SL into the inside of the magnet is promoted.

For example, when an Nd—Cu alloy is used as the modifying alloy SL, as the main phase contains Pr with a lower melting point than Nd, the outer side of the main phase (i.e., an interface region between the main phase and the grain boundary phase) dissolves due to heat that is generated while the Nd—Cu alloy is diffused in the grain boundaries, so that the dissolved region expands with the grain boundary phase BB in the molten state.

Consequently, although the proportion of the grain boundary phase BP, which serves as an infiltration path for the Nd—Cu alloy, has been low due to the high proportion of the main phase, it becomes possible to increase the efficiency of infiltration of the Nd—Cu alloy with the expanded infiltration path. Consequently, the Nd—Cu alloy can sufficiently infiltrate the inside of the magnet.

After the Nd—Cu alloy is diffused in the grain boundaries by the heat treatment in the third step, the temperature is returned to the room temperature. Thus, the outer region of the main phase MP, which has dissolved so far, is recrystallized, whereby a main phase with a core-shell structure is formed that includes a core phase in the center region of the main phase and a shell phase in the recrystallized outer region (see FIG. 5).

The thus formed main phase with the core-shell structure can maintain the initial high proportion of the main phase. Thus, it is possible to obtain a rare-earth magnet with excellent magnetization performance as well as excellent coercivity performance as the Nd—Cu alloy is sufficiently diffused in the grain boundaries of the grain boundary phase. As an example of such a core-shell structure, a (PrNd)FeB phase, which is a Pr-rich phase, can be used for the composition of the core that forms the main phase, and a (NdPr)FeB phase, which is a relatively Nd-rich phase, can be used for the composition of the shell around the core.

[Experiments of Verifying the Magnetic Properties of Rare-Earth Magnets Produced with the Production Method of the Present Invention and the Results Thereof]

The inventors produced a plurality of rare-earth magnets by applying the production method of the present invention and variously changing the concentration of Pr in the magnetic materials, and then conducted experiments of identifying the relationship between the infiltration temperature of the modifying alloy and the coercivity of the rare-earth magnets. In addition, the inventors also conducted experiments of identifying the temperature dependence of the coercivity of each rare-earth magnet. Further, the inventors conducted experiments of identifying the relationship between the substitution rate of Pr and the coercivity at room temperature and under a high-temperature atmosphere. Furthermore, the inventors conducted EDX analysis and confirmed that the main phase has a core-shell structure.

(Experimental Method)

Figure 6:
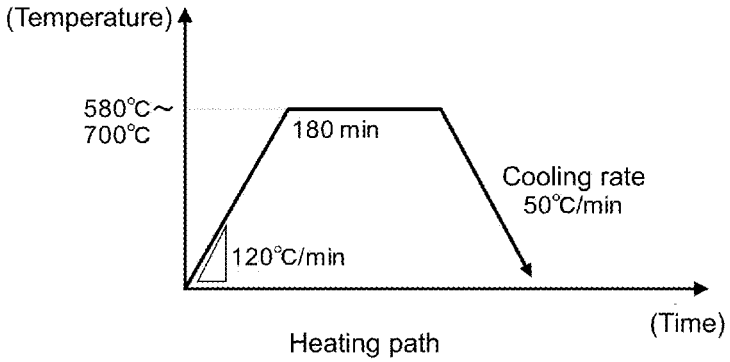
FIG. 6 is a diagram illustrating the heating path in the third step in producing a specimen.
Figure 7:
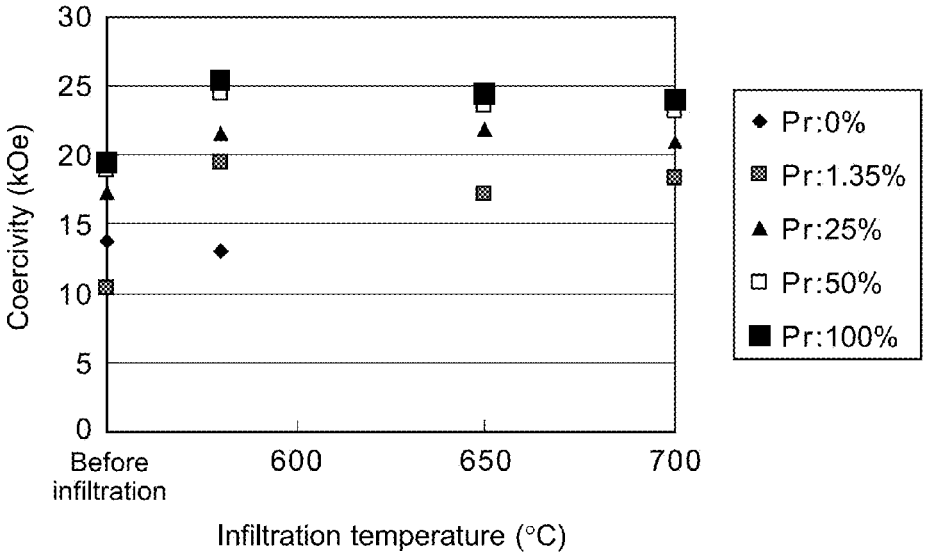
FIG. 7 is a diagram showing the relationship between the infiltration temperature of a modifying alloy and the coercivity of the produced rare-earth magnet in experiments, for each amount of substitution of Pr.
Figure 8:
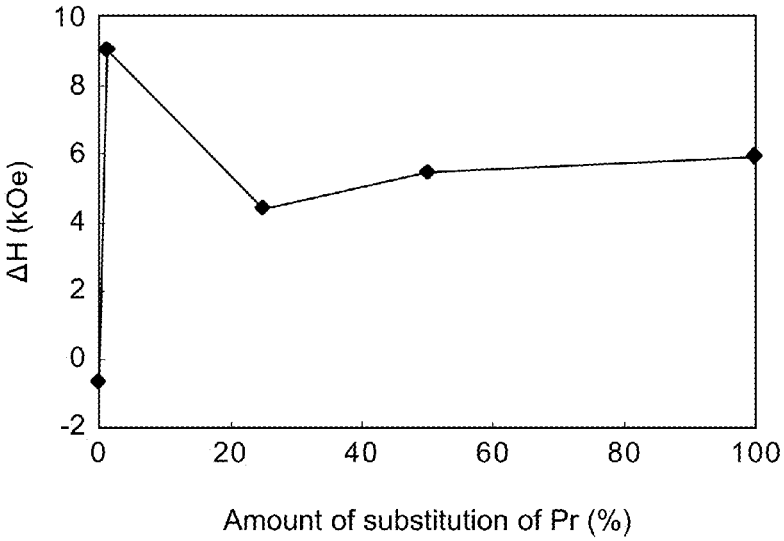
FIG. 8 is a diagram showing the relationship between the amount of substitution of Pr and the amount of increase of coercivity in an experiment at an infiltration temperature of 580° C.
Figure 9:
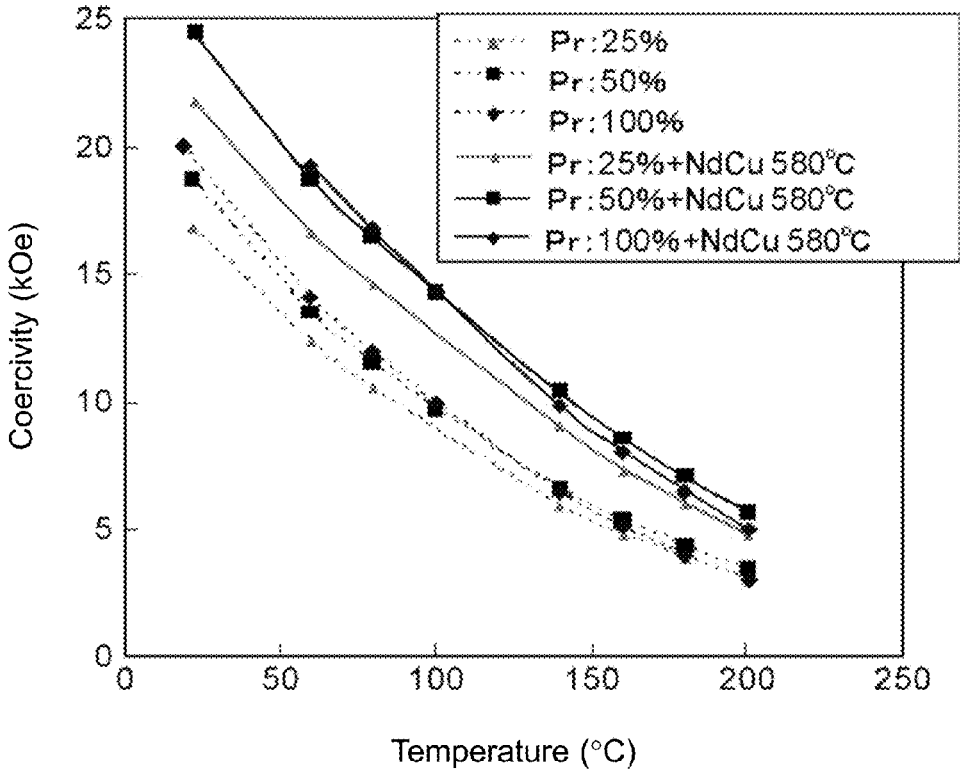
FIG. 9 is a diagram showing the relationship between the temperature and the coercivity of each of a rare-earth magnet that contains Pr in the main phase and does not contain a modifying alloy diffused in the grain boundaries and a rare-earth magnet that contains Pr in the main phase and also contains a modifying alloy diffused in the grain boundaries.
Figure 10:
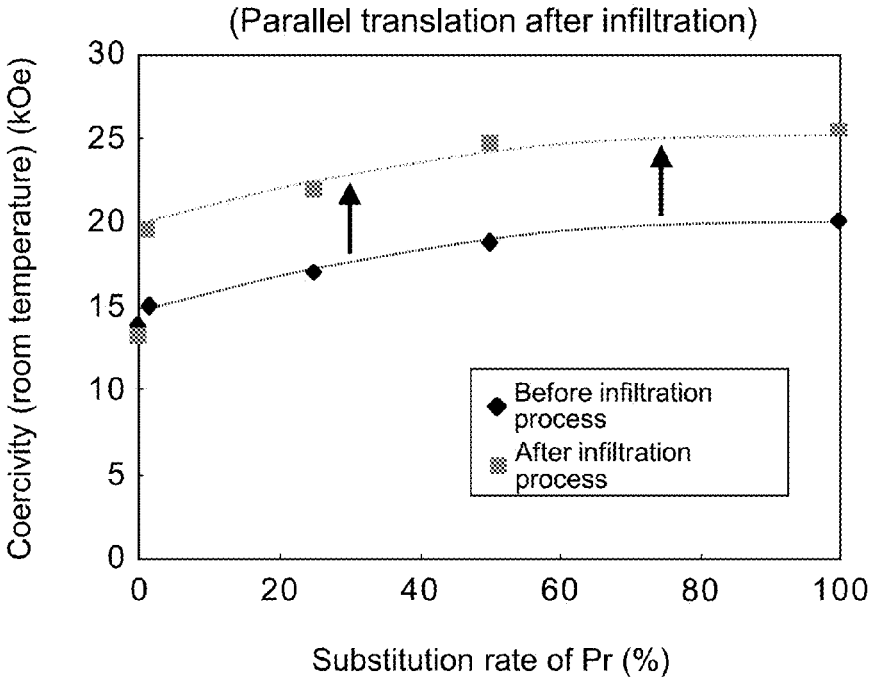
FIG. 10 is a diagram showing the relationship between the amount of Pr in the main phase and the coercivity at room temperature.
Figure 11:
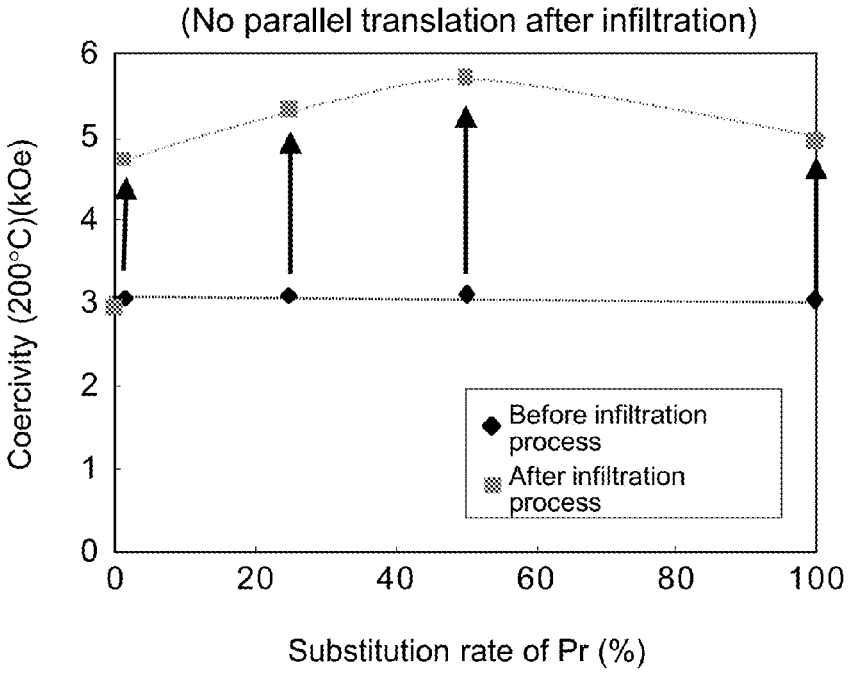
FIG. 11 is a diagram showing the relationship between the amount of Pr in the main phase and the coercivity under an atmosphere of 200° C.

A liquid quenched ribbon with a composition: $(Nd_{(100-x)}Pr_x)_{13.2}Fe_{bal}B_{5.6}Co_{4.7}Ga_{0.5}$ (at %) was produced with a single-roller furnace (X=0, 1.35, 25, 50, or 100), and the obtained quenched ribbon was sintered to produce a sintered body (at a sintering temperature of 650° C. at 400 MPa). Then, high-strength processing was applied to the sintered body (at a processing temperature of 780° C. and a degree of processing of 75%) to produce a precursor of a rare-earth magnet. Then, heat treatment was applied to the obtained precursor of the rare-earth magnet in accordance with a heating path diagram shown in FIG. 6 to perform a process of infiltrating a Nd—Cu alloy, thereby producing a rare-earth magnet (the modifying alloy used was a $Nd_{70}Cu_{30}$ material: 5%, and the thickness of the magnet before diffusion was 2 mm). The magnetic properties of each of the produced rare-earth magnets was evaluated with VSM and TPM. FIG. 7 shows the measurement results regarding the relationship between the infiltration temperature of the modifying alloy and the coercivity of the produced rare-earth magnet. FIG. 8 shows the experimental results regarding the relationship between the amount of substitution of Pr and the amount of increase of coercivity at an infiltration temperature of 580° C. FIG. 9 shows the experimental results regarding the temperature dependence of coercivity. Further, FIGS. 10 and 11 show the experimental results regarding the relationship between the amount of substitution of Pr and the coercivity at room temperature and under a high-temperature atmosphere (200° C.), respectively.

From FIG. 7, it is found that each composition experiences little change even when the infiltration temperature is changed from 580 to 700° C. Herein, from the relationship between the concentration of Pr and the rate of change of coercivity at an infiltration temperature of 580° C. shown in FIG. 8, it is found that infiltration does not occur efficiently when the concentration of Pr is 0%, resulting in decreased coercivity, whereas the coercivity greatly improves at concentrations other than 0%.

This is considered to be due to the fact that when the main phase has a small amount of Pr added thereto, the efficiency of infiltration of the Nd—Cu alloy will increase, and thus, the Nd—Cu alloy can sufficiently infiltrate the inside of the magnet.

Next, from FIG. 9, it is found that a rare-earth magnet that contains Pr in the main phase and also contains a Nd—Cu alloy infiltrated therein has higher coercivity than a rare-earth magnet without a Nd—Cu alloy infiltrated therein by about as large as 5 kOe.

In addition, from FIGS. 10 and 11, it is found that after a Nd—Cu alloy is infiltrated at room temperature, the coercivity tends to increase in a parallel translation manner in the range in which the coercivity improves even when the concentration of Pr is changed, while at 200° C., the coercivity tends to increase not in a parallel translation manner but by the amount of parallel translation+α in the range in which the coercivity improves.

This is considered to be due to the fact that at room temperature, the effect of improving the separation property of the crystal grains of the main phase by the Nd—Cu alloy has a great influence, while at 200° C., not only is there the effect of improving the separation property but also the average magnetocrystalline anisotropy at high temperature is improved by the formation of the core-shell structure upon occurrence of the substitution of elements at the interface of the main phase.

To be more specific, in the range in which the amount of substitution of Pr is 1 to 50%, an amount of increase of coercivity by a gain of +α is observed, while at a substitution rate of 100%, it is considered that the gain is lost under the strong influence of the deterioration of the magnetocrystalline anisotropy of the core phase under a high-temperature atmosphere.

Figure 12:
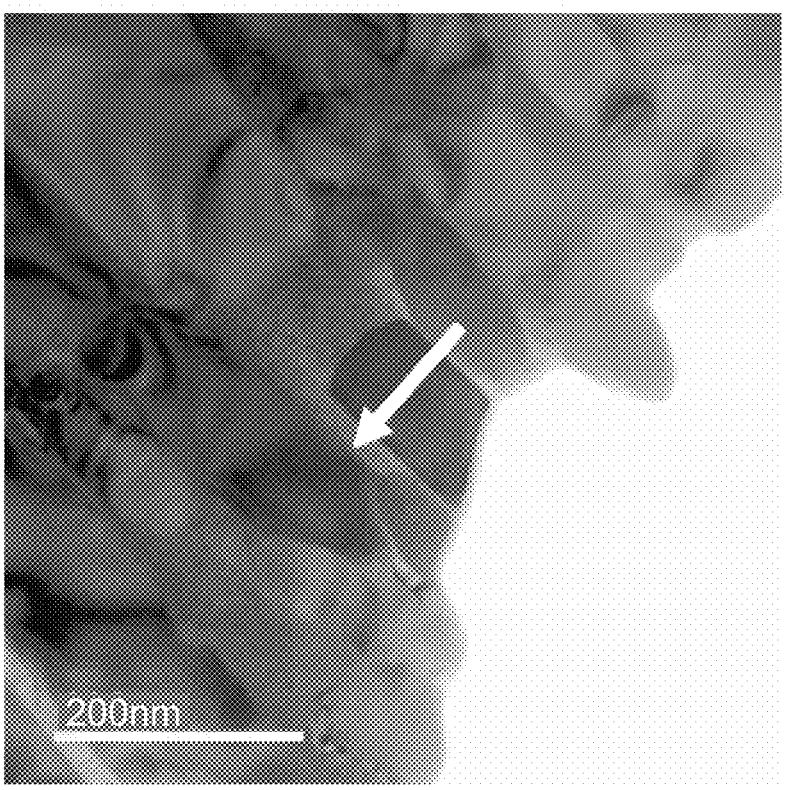
FIG. 12 is a TEM photograph of a rare-earth magnet.
Figure 13:
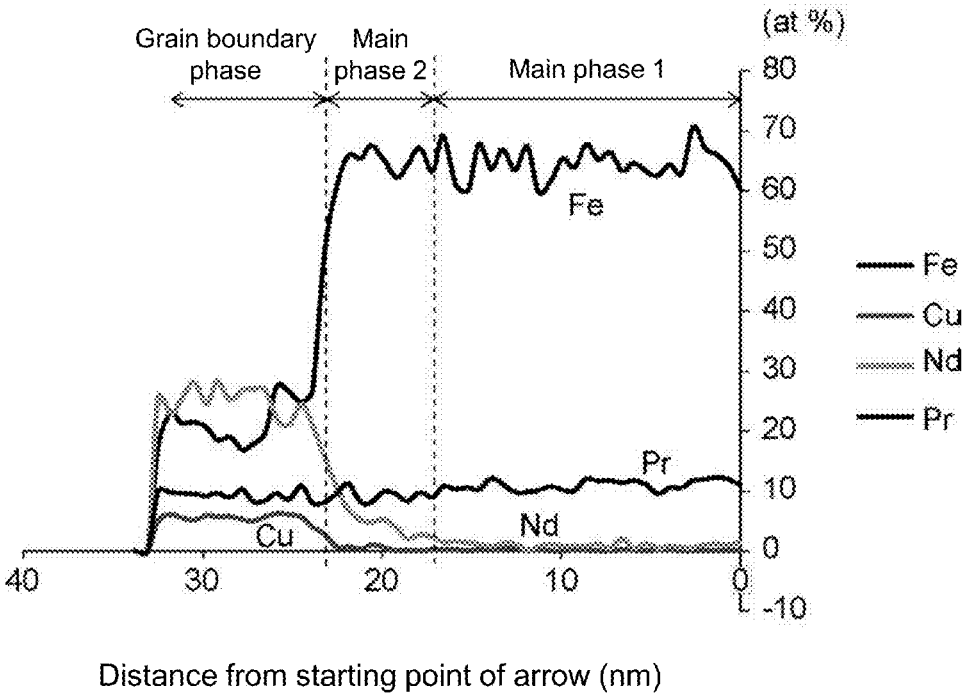
FIG. 13 is a diagram showing the analysis results of EDX lines.

FIG. 12 shows a TEM photograph of the structure of the rare-earth magnet, and FIG. 13 shows the analysis results of EDX lines.

In FIG. 13, zero at the abscissa axis represents the starting point of the arrow in FIG. 12, and the abscissa axis represents the length of the structure from the starting point. A main phase 1 is the core phase and a main phase 2 is the shell phase. The total length of the main phases 1 and 2 is about 23 nm, and the grain boundary phase is located on the outer side thereof.

The present analysis of the EDX lines can confirm that according to the magnet composition used in the experiments, the main phase 1 has a high Pr content and the main phase 2 has a high Nd content, and thus that a main phase with a core-shell structure with different compositions is formed.

The main phase 1 that forms the core phase is a phase with high coercivity at room temperature, while the main phase 2 that forms the shell phase on the outer side of the core phase is a phase with high coercivity at high temperature. With the production method of the present invention, it is possible to produce a magnet with high coercivity as the separation property is improved as a result of a Nd—Cu alloy having been sufficiently infiltrated. It should be noted that as the produced rare-earth magnet has a proportion of the main phase as high as 96 to 97%, such a magnet has high magnetization in addition to high coercivity.

The present experiments have verified that the method for producing the rare-earth magnet in accordance with the present invention is an innovative production method that can increase not only the magnetization but also the coercivity of a rare-earth magnet that has a high proportion of a main phase and thus can otherwise frequently have a grain boundary phase in which a melt of a modifying alloy is not sufficiently infiltrated.

Although the embodiments of the present invention have been described in detail with reference to the drawings, specific structures thereof are not limited thereto. Any design changes that may occur within the spirit and scope of the present invention fall within the present invention.

DESCRIPTION OF SYMBOLS

R Copper roll
B Quenched thin strip (Quenched ribbon)
D Carbide die
P Carbide punch
S Sintered body
C Precursor of rare-earth magnet
H High-temperature furnace
SL Modifying alloy powder (Modifying alloy)
M Modifying alloy powder
MP Main phase (nanocrystal grains, crystal grains)
BP Grain boundary phase
RM Rare-earth magnet

What is claimed is:

1. A method for producing a rare-earth magnet, comprising:

a first step of producing a sintered body with a structure including a main phase and a grain boundary phase, the sintered body consists of Nd, Pr, Fe, B, and M wherein the sintered body has a composition expressed by a formula: $(Nd_{1-x}Pr_x)_aFe_bB_cM_d$ where B represents boron, M is at least one selected from the group consisting of Ti, Ga, Zn, Si, Al, Nb, Zr, Ni, Co, Mn, V, W, Ta, Ge, Cu, Cr, Hf, Mo, P, C, Mg, Hg, Ag, and Au, $0<x<0.5$, $12\leq a\leq 20$, $b=100-a-c-d$, $5\leq c\leq 20$, and $0\leq d\leq 20$, and $0\leq d\leq 3$ all by at %;

a second step of applying hot deformation processing to the sintered body to produce a precursor of a rare-earth magnet; and a third step of providing a Nd-Cu alloy consisting of Nd and Cu on a surface of the precursor of the rare-earth magnet and then heat treating the precursor of the rare-earth magnet to diffuse and infiltrate a melt of the Nd-Cu alloy into the grain boundary phase of the precursor of the rare-earth magnet to produce a rare-earth magnet, wherein the rare-earth magnet has a main phase with a core-shell structure, wherein a composition of a shell formed around the core is a (NdPr)FeB phase, in which a content of Nd is more than a content of Pr, wherein a proportion of the main phase to the entire structure of the rare-earth magnet being is 95% or greater by volume percent, and the rare-earth magnet has a coercivity at 200° C. of higher than 4.8 kOe and less than 5.6 kOe.

* * * * *